United States Patent [19]

Prince

[11] 4,319,125

[45] Mar. 9, 1982

[54] INFRA-RED RADIANT HEATER SYSTEM

[76] Inventor: Fred J. Prince, 2133 Waynoka Rd., Euclid, Ohio 44117

[21] Appl. No.: 59,288

[22] Filed: Jul. 20, 1979

[51] Int. Cl.[3] ..... F24H 9/06; F24H 9/14

[52] U.S. Cl. ..... 219/347; 165/DIG. 6; 165/133; 219/348; 219/349; 237/70

[58] Field of Search ..... 126/92 B, 92 A, 91 R, 126/91 A; 219/347, 348, 349; 165/133, DIG. 6; 237/70; 362/255, 277, 297, 298, 306

[56] References Cited

U.S. PATENT DOCUMENTS

| | | | |
|---|---|---|---|
| 670,905 | 3/1901 | Pittman | 362/255 |
| 3,115,302 | 12/1963 | Corey | 237/2 |
| 3,377,482 | 4/1968 | Podany | 362/255 |
| 3,394,886 | 7/1968 | Budden | 237/2 |
| 3,399,833 | 9/1968 | Johnson | 237/53 |

OTHER PUBLICATIONS

Brochure Reflect-Ray (Exhibit A).

Brochure Reflect-o-Ray (Exhibit D) (1965) Reflectoray Corp.

Brochure Roberts Gorden Corp. (Exhibit E).

Reflectoray Brochure Exhibit B & C.

*Primary Examiner*—Gerald P. Tolin

*Assistant Examiner*—Bernard Roskoski

[57] ABSTRACT

A radiant heater system with a heat-radiating tubular conduit and a reflector for reflecting heat radiated by the conduit. The tubular conduit is supported along its length by spaced support structures. The reflector is disposed between and spaced from two successive ones of the support structures by attachment assemblies secured to and carried by the conduit and that permit full rotational adjustment of the reflector about the longitudinal axis of the tubular conduit. In a preferred arrangement, the heater system has a dispersing reflector adjacent a relatively hot portion of the conduit and a parabolic or concentrating reflector adjacent a colder portion of the conduit to compensate for a varying intensity of heat radiated by the different temperature portions of the conduit.

6 Claims, 5 Drawing Figures

INFRA-RED RADIANT HEATER SYSTEM

BACKGROUND OF THE INVENTION

This invention relates to infra-red radiant heater systems and to rotatably adjustable reflectors for the systems.

An infra-red heater of the present type generally involves a system in which a heated fluid is passed through a tubular conduit to heat the conduit. The conduit directly radiates heat waves to an adjacent area and preferably acts in conjunction with a reflector, adjacent to and spaced from the conduit, that directs the heat in a desired direction.

Infra-red radiant heater systems are useful to warm entire commercial or industrial spaces. By using a heater system of this type, it is possible to effectively warm objects on loading docks, near open doorways, or anywhere conditions cause a high heat loss.

Problems have arisen which have hampered the usefulness of infra-red heaters, among which are insufficient heat supplied to areas in which heat is needed, non-uniform heat supplied to an area adjacent the length of the conduit, and too much heat directed to certain areas adjacent sections of the conduit.

Prior arrangements use reflectors supported by hangers supported from ceilings or other overhead structures. Typically, the support members for the reflectors also directly support the tubular conduit. Many of these reflectors have a fixed position and can reflect heat from a conduit only toward a single area. Often a fixed reflector does not direct heat precisely toward a desired object, especially where the location of the object to be heated is shifted from an original position. Further, since the temperature of the tubular conduit decreases in the downstream direction of fluid flow due to the drop in temperature of the fluid as it passes through the conduit, the heat waves radiated by the conduit and reflected by the reflector are of differing intensity along the length of the conduit. As a consequence, often either too much or too little heat was directed by the fixed reflector to certain areas adjacent sections of the tubular conduit.

Some known reflectors allow adjustment to vary the direction of reflected heat, but this adjustment is small and is limited by support members for the tubular conduit.

Because of the above shortcomings and others of known heaters, a need exists for an infra-red heater system having a full range of adjustment in directing heat reflected along a tubular conduit with the ability to vary the direction of heat reflected along the conduit and to vary the concentration of reflected heat at given areas along the length of the conduit.

SUMMARY OF THE INVENTION

The present invention is an improved infra-red heater system that meets the above needs and others. The improved infra-red heater system basically comprises a tubular conduit that radiates heat, a plurality of support structures for supporting the conduit at spaced locations along its length, one or more reflectors each between and spaced from successive ones of the support structures, and attachment assemblies securing each reflector to the tubular conduit in a manner to permit full rotational adjustment of the reflector about the longitudinal axis of the conduit. Because each reflector is spaced between successive support structures, rotation of the reflector is not obstructed or otherwise limited by the supports. As a result, the reflector can be fully rotated about the longitudinal axis of the conduit, without adjusting the conduit support. Thus, the reflector can be readily adjusted to precisely direct heat from the reflector toward an object not aligned directly beneath the conduit and the direction of the heat can be modified as required to heat an object having a shiftable location.

Because the reflector of the present invention is carried by the conduit and not directly by the support structures for the conduit, a plurality of rotatable reflectors can be positioned at different angles to vary the direction of reflected heat along the conduit. This feature is extremely useful when areas adjacent an infra-red heater each require a different amount of heat. For example, if one of the reflectors directed too much heat to a work area, the reflector could be canted to direct heat away from the work station while the other reflectors would have their original positions and directions of reflection remain unchanged. Also, more than one reflector could be canted to direct heat toward or away from various areas adjacent to and along sections of the tubular conduit.

The use of plural rotatably adjustable reflectors along the length of a tubular conduit can serve many other purposes. For example, by utilizing combinations of reflectors that either disperse or collimate reflected heat rays, heat can be concentrated and dispersed at selective areas adjacent to and along the entire length of a tubular conduit. Also, by utilizing a reflector that disperses heat radiated from a relatively hot section at the beginning of the conduit and by utilizing a reflector that concentrates heat radiated from colder, downstream sections of the conduit it is possible to direct a relatively uniform amount of heat to areas adjacent to and along the entire length of a conduit.

The above and other features and advantages of this invention will become more apparent as the invention becomes better understood from the detailed description that follows, when considered in conjunction with the accompanied drawings.

DETAILED DESCRIPTION OF THE PREFERRED EMBODIMENT

Figure 1:
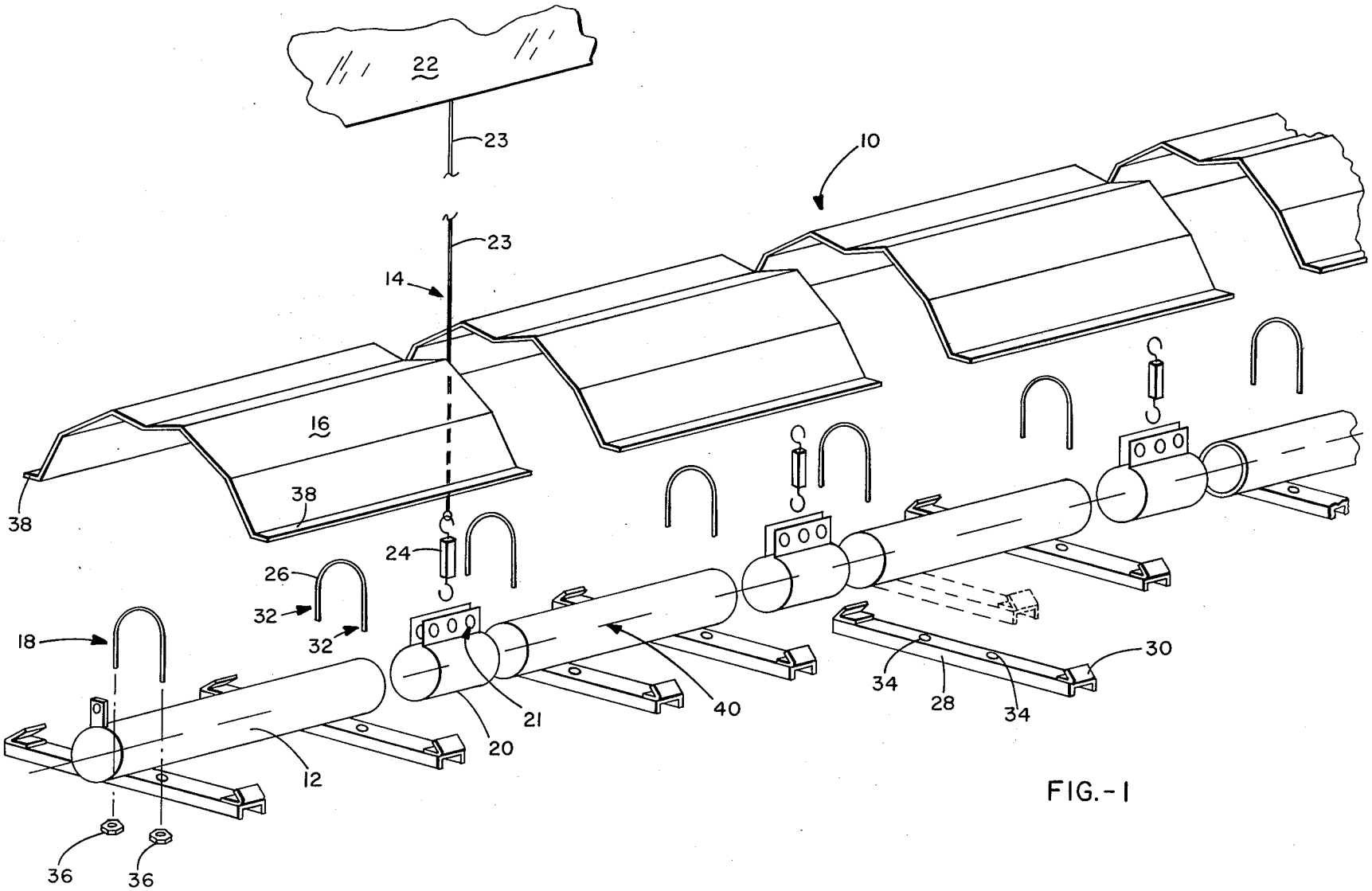
FIG. 1 is an exploded perspective view of an infra-red heater system constructed in accordance with the present invention.

Referring to the drawings, FIG. 1 illustrates an infra-red radiant heater system generally designated by the reference numeral 10. The system has a plurality of tubular conduits 12, a plurality of support structures 14 for supporting the conduits, a plurality of reflectors 16 for reflecting heat radiated from the conduits, and attachment assemblies 18 for adjustably securing the reflectors to the conduits.

The plurality of tubular conduits 12 are interconnected by clamps 20 located between successive conduits. An upper flange of each clamp 20 is spot welded, as at 21, to secure the clamp in fixed relation to a pair of conduits 12. One end of the interconnected conduits is connected to an exhaust conduit of a burner (not shown) that can be either gas or oil fired. Products of combustion from the burner (i.e. a heated fluid) are passed through the interconnected conduits 12 to heat the walls of the conduits.

The tubular conduits 12 are suspended from an overlying body (exemplified by reference numeral 22 in FIG. 1) by the support structures 14. Each support structure includes a cable 23 connected at one end to the overlying body and at its other end to a turnbuckle 24, which is attached to one of the clamps 20.

Figure 3:
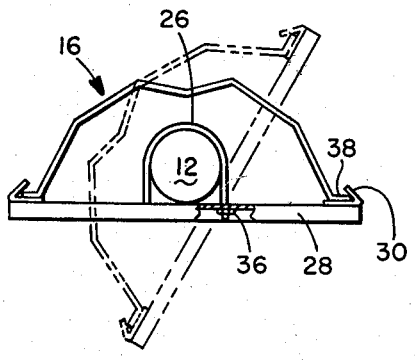
FIG. 3 is a cross sectional view taken along line 3—3 of FIG. 2.

Each reflector 16 is carried by and secured to one of the tubular conduits 12 by a pair of attachment assemblies 18. Each attachment assembly 18 includes a U-bolt 26 and a support bracket 28 having a pair of reflector clips 30, one reflector clip attached to each end of the support bracket. As best shown in FIG. 3, the U-bolt 26 is fitted around a portion of one tubular conduit 12, with threaded ends 32 extending through holes 34 in an associated support bracket 28. Nuts 36 clamp the U-bolt in place to confine the tubular conduit between the U-bolt 26 and the central portion of the support bracket 28.

Figure 2:
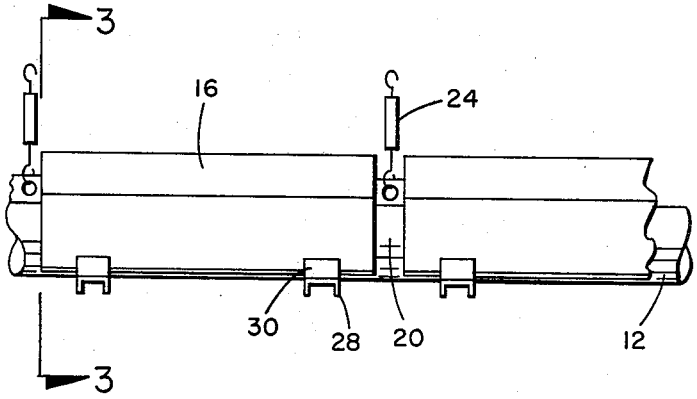
FIG. 2 is a fragmentary front elevational view of FIG. 1.

Each of the reflectors 16 has two edge flanges 38 which extend longitudinally along the reflector. As best shown in FIGS. 2 and 3, the reflectors are secured to the support brackets 28 by the reflector clips 30 of the brackets, which retain the edge flanges 38. Since the support brackets are fixedly secured to the tubular conduits 12, the reflectors 16 are secured to the tubular conduits by the support brackets.

As shown in FIG. 3, a reflector 16 of the present invention can be rotated about the longitudinal axis 40 of the interconnected tubular conduits 12. This is accomplished by loosening each nut 36 (of the pair of attachment assemblies 18 that secure the reflector to the interconnected conduits) to loosen the attachment between two U-bolts 26 and the tubular conduit which extends through the U-bolts. The support brackets 28 attached to the two U-bolts 26 are rotated along with the associated reflector 16 to a desired position (exemplified by the phantom illustration in FIG. 3). Upon reaching the desired position, each loosened nut 36 is now tightened until the two U-bolts, the two support brackets, and the reflector are secured in fixed position relative to the longitudinal axis 40 of the interconnected tubular conduits.

Since the reflectors 16 are spaced from one another and spaced between successive ones of the support structures 18, and are carried by independently rotatable, different pairs of attachment assemblies secured to the conduits 12, each reflector 16 can be rotated independently. Accordingly, the reflectors can be positioned at different angles, through a full 360° if desired, along the length of the interconnected tubular conduits 12.

Figure 4:
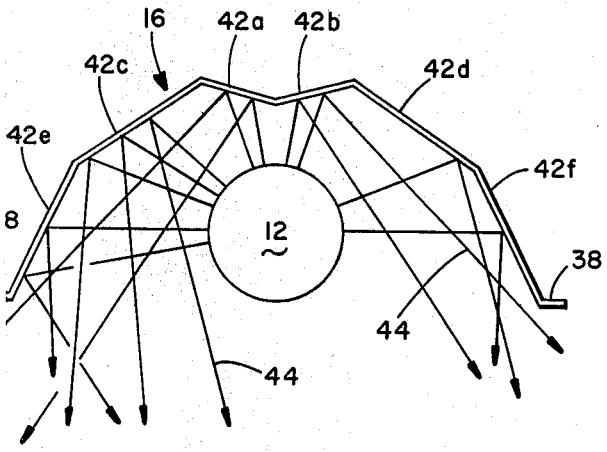
FIG. 4 is an enlarged fragmentary diagrammatic end view of a reflector and a tubular conduit of FIG. 3; and, FIG. 5 is a view similar to FIG. 4 of another embodiment of a reflector used in accordance with the present invention.

Reflectors 16 represent a preferred embodiment of a reflector used in accordance with the present invention. As best illustrated in FIG. 4, each reflector 16 has flat sections 42*a–f*. Two of the sections, 42*a* and 42*b*, form a converging V-shaped, upper reflector portion which overlies a tubular conduit 12 and prevents reflection of heat waves back to an upper portion of the conduit. The other sections 42*c*, 42*d*, 42*e*, and 42*f* form two inverted V-shaped portions (42*c*, 42*e* and 42*d*, 42*f*) of the reflector 16 that extend from and combine with the V-shaped, upper reflector portion to provide a reflector shape that disperses reflected heat waves (represented by arrows 44) over a span greater than the width of the reflector.

Figure 5:
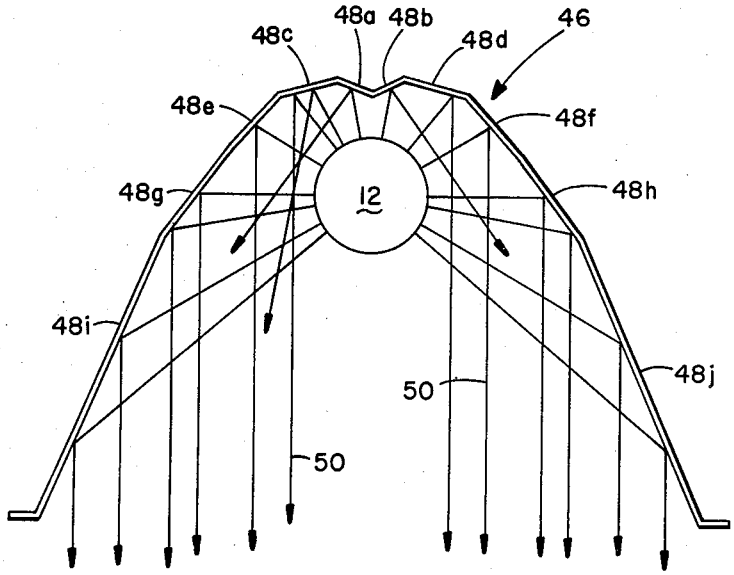

FIG. 5 illustrates another reflector contour. A reflector 46 has a converging V-shaped, upper reflector portion, formed by flat sections 48*a* and 48*b*, for reducing reflection of radiant heat back to an upper portion of the tubular conduit 12. A pair of generally parabolic portions, formed by flat sections 48*c*, 48*e*, 48*g*, 48*i* and 48*d*, 48*f*, 48*h*, 48*j*, extend from the V-shaped, upper reflector portion and direct reflected heat waves (represented by arrows 50) substantially parallel to one another and substantially confined within a span comparable to the width of the reflector 46, thereby concentrating the radiant heat from the conduit to a greater extent than the reflector 16.

The reflector 46 is rotatably attached to a string of interconnected tubular conduits 12 by a pair of attachment assemblies similar to assemblies 18. Instead of the reflector 46 being secured by end flanges within reflector clips of a support bracket, a support bracket (not shown) similar to bracket 28 abuts the inner or reflecting surface of reflector 46 and the reflector is attached to the abutting support bracket by screws passing through the reflector 46 and the bracket.

As illustrated in FIG. 5, the generally parabolic portions of reflector 46 are longer than the inverted V-shaped portons of reflector 16. This extra length is necessary to insure that the generally parabolic portions direct reflected heat waves substantially parallel to one another and substantially confined within a span comparable to a reflector width.

Both the reflectors 16 and 46 are preferably fabricated from aluminum sheets of 0.032 inch thickness by die stamping. The aluminum sheets are polished on one side to create a highly reflective surface.

As previously explained, heated fluid from a burner passes through the interconnected tubular conduits 12 and heats the tubular conduits, which in turn radiate heat, a portion of which is directed by reflectors to areas adjacent the length of the conduits. The heated fluid loses heat as it flows downstream through the conduits. Accordingly, the tubular conduit 12 that abuts the exhaust conduit of the burner from which the heat initially passes is normally hotter than a tubular conduit downstream. Since the amount of heat radiated by a tubular conduit is proportional to the temperature of the conduit, the amount of heat rediated from a downstream conduit is less than that radiated from the conduit that abuts the exhaust conduit of the burner. By utilizing a reflector 16 that disperses heat radiated from the relatively hot conduit 12 that abuts the exhaust conduit of the burner and by utilizing reflectors 46 that concentrate heat radiated from one or more colder downstream conduits, it is possible to direct a relatively uniform amount of radiated heat along the length of the interconnected conduits 12. To further reduce the variance of directed heat along the interconnected tubular conduits 12, the tubular conduit that abuts the exhaust conduit of the burner is made of aluminum to minimize radiation while downstream tubular conduits are painted black to enhance radiation.

It will be appreciated from the foregoing that an infra-red radiant heater system is provied which allows radiant heat to be readily directed, the extent of heated area to be controlled, and the variation in temperature of radiant heat along the system to be reduced.

While preferred embodiments of the invention have been disclosed in detail, various modifications or alterations may be made herein without departing from the spirit and scope of the invention set forth in the appended claims.

What is claimed is:

1. A radiant heater system comprising:

(a) a tubular conduit through which hot fluid is transported from one end to another and along which the temperature varies;

(b) a plurality of support structures for supporting the conduit at spaced locations along its length;

(c) a first reflector between and spaced from two successive support structures, the first reflector constructed and shaped to reflect and disperse heat waves from the conduit;

(d) a second reflector between and spaced from two successive support structures, the second reflector constructed and shaped to reflect heat in a path more confined than that of the first reflector; and (e) the first reflector being adjacent a hotter portion of the conduit than the second reflector.

2. The radiant heater system of claim 1 further including attachment means securing at least one of the reflectors to the conduit to permit rotational adjustment of the at least one reflector about a longitudinal axis of the conduit.

3. A radiant heater system comprising:

(a) a plurality of connected tubular conduits of like diameter, through which hot fluid is transported and along which the temperature varies;

(b) a plurality of support structures for supporting the conduits at spaced locations at junctures of the conduits, said support structures comprising tubular clamps at junctures of the conduits that connect the conduits together and spaced suspensions supported above the conduits and connected to the tubular clamps;

(c) a first reflector between and spaced from two successive support structures and supported directly upon a tubular conduit by clamping means carried by the reflector and independent from the suspensions, constructed to permit individual angular adjustment of the reflector about the conduit independently from any other reflector, said first reflector constructed and shaped to reflect and disperse heat waves from the conduit to which it is secured;

(d) a second reflector between and spaced from two successive support structures and supported directly upon the tubular conduit by clamping means carried by the reflector and independent from the suspensions, constructed to permit individual angular adjustment of the reflector about the conduit independently from any other reflector, the second reflector constructed and shaped to reflect heat in a path more confined than that of the first reflector; and (e) the first reflector being adjacent a hotter tubular conduit than the second reflector.

4. A radiant heater system as set forth in claim 1 wherein said clamping means securing each reflector to a tubular conduit includes two longitudinally spaced members secured to the reflector, each member being comprised of a clamp encircling the tubular conduit to which the reflector is secured, said clamp being urged into engagement with the conduit by threaded fasteners to establish a desired fixed position that can be rotatably adjusted about the conduit.

5. A radiant heater system comprising:

(a) a tubular conduit through which hot fluid is transported and along which the temperature varies;

(b) a plurality of support structures for supporting the conduit at spaced locations;

(c) a first reflector supported by a portion of the conduit, constructed and shaped to reflect and disperse heat waves from the conduit by which it is supported;

(d) a second reflector supported by a different portion of the conduit, constructed and shaped to reflect heat from the conduit in a path more confined than that of the first reflector; and (e) the first reflector being located adjacent a portion of the tubular conduit that is hotter than the portion adjacent which the second reflector is supported.

6. A radiant heater system as set forth in claim 5 comprising:

a plurality of aligned elongated tubular conduits of like diameter, tubular clamps at junctures of the conduits connecting the conduits together and serving as supports for the conduits, spaced suspensions supported above the conduits and connected to the tubular clamps to suspend the clamps and conduits from an overhead structure, said of reflectors elongated longitudinally of and parallel to the tubular conduits, one associated with each tubular conduit and located between and free from spaced suspensions, and clamping means securing each reflector to a tubular conduit between the tubular clamps for individual angular adjustment about the conduit independently of any other reflector, said clamping means comprising two longitudinally spaced members secured to the reflector, each with a clamp encircling the tubular conduit to which the reflector is secured, said clamp being urged into engagement with the conduit by threaded fasteners that adjustably establish a clamping force against the tubular conduit and a fixed position of the reflector while allowing rotatable adjustment of the reflector about the conduit to permit reflected heat from the tubular conduits to be selectively directed in different directions along the length of said connected conduits without adjustment of the suspensions.

* * * * *

UNITED STATES PATENT AND TRADEMARK OFFICE

CERTIFICATE OF CORRECTION

PATENT NO. : 4,319,125

DATED : March 9, 1982

INVENTOR(S) : Fred J. Prince

It is certified that error appears in the above—identified patent and that said Letters Patent is hereby corrected as shown below:

Title page should state: Assignee: Solaronics, Inc.
Rochester, Michigan

Column 4, line 51, "rediated" should be - radiated --.

Column 6, line 4 (claim 4) "1" should be -- 3 --.

Signed and Sealed this

*Fifteenth* Day of *June 1982*

[SEAL]

*Attest:*

GERALD J. MOSSINGHOFF

*Attesting Officer*

*Commissioner of Patents and Trademarks*